US007455596B1

(12) United States Patent
Greene

(10) Patent No.: US 7,455,596 B1
(45) Date of Patent: Nov. 25, 2008

(54) ALIGNMENT DEVICE FOR ALIGNING AN IMPACT POINT OF A GOLF BALL

(76) Inventor: Phillip R. Greene, 4516 Columbine Ct., Charlotte, NC (US) 28226

( * ) Notice: Subject to any disclaimer, the term of this patent is extended or adjusted under 35 U.S.C. 154(b) by 0 days.

(21) Appl. No.: 11/767,944

(22) Filed: Jun. 25, 2007

(51) Int. Cl.
*A63B 69/36* (2006.01)

(52) U.S. Cl. ..... 473/257; 473/261; 473/266; 473/268

(58) Field of Classification Search ..... 473/257, 473/261, 262, 264, 265, 266, 268, 269
See application file for complete search history.

(56) References Cited

U.S. PATENT DOCUMENTS 3,656,752 A * 4/1972 Moriarty ..... 473/261
5,211,400 A * 5/1993 Hall et al. ..... 473/268
5,375,833 A * 12/1994 Marier, Jr. ..... 473/261
5,375,844 A * 12/1994 Waud ..... 473/268
5,899,816 A * 5/1999 Pearson ..... 473/265
2005/0277482 A1* 12/2005 Bennett ..... 473/257

* cited by examiner

*Primary Examiner*—Nini Legesse
(74) *Attorney, Agent, or Firm*—Adams Intellectual Property Law, P.A.

(57) ABSTRACT

An alignment device for aligning an impact point of a golf ball in order to correlate the perceived alignment of the ball by a golfer with the actual direction of impact required to maximize the probability of the ball traveling in the desired direction.

11 Claims, 11 Drawing Sheets

ALIGNMENT DEVICE FOR ALIGNING AN IMPACT POINT OF A GOLF BALL

TECHNICAL FIELD AND BACKGROUND OF THE INVENTION

This invention relates to an alignment device for aligning a putter on an intended line that traverses through an impact point of a golf ball resting on the intended line. The golfer is therefore able to correlate the perceived alignment of the ball with the actual direction of impact required to maximize the probability of the ball traveling in the desired direction. Putting a golf ball, i.e., hitting the ball with a putter, usually on a part of a golf course called a "green," requires several skills operating at the same time. The relative "speed" of the green, the uphill, downhill and/or sidehill slope of the green, the lie of the ground beneath the ball and the way the golfer sets up over the ball all affect the decisions reached by the golfer on how to strike the ball and, consequently, affects the way the ball rolls. The golfer can control setup. However, the other factors are considerations that may affect how the golfer reads the break or how hard the golfer strikes the putt, but they are not controlled by the golfer. However, the golfer can control the setup, which affects the ability to properly strike and roll the ball. There are actually nine different possible slope categories, with an infinite number of combinations within each category, that a golfer must consider when setting up to the ball: 1) straight flat lie, 2) straight downhill lie, 3) straight uphill lie, 4) left to right uphill lie, 5) left to right downhill lie, 6) right to left uphill lie, 7) left to right downhill lie, 8) straight sidehill lie that ultimately breaks left, and 9) straight sidehill lie that ultimately breaks right. Aside from the environmental factors, there is a perceptual factor based on parallax between the position of the player's body and the ball that affects the ability of the golfer to translate what is perceived as the required direction of impact on the ball, into the direction of actual impact. If the body, particularly the head, eyes and shoulders, is not correctly aligned, the player will believe that the ball is being struck in the desired direction, when in fact the ball is being struck in a direction not desired by the player, causing the ball to pass to the left or right of the hole.

The principle behind the invention described in this application is that the more closely and consistently the ball is positioned in a perpendicular orientation under the dominant eye of the golfer, the greater the probability that the putter will be aligned properly behind the ball so that the ball will be struck in such a manner so as to propel it in the desired direction. By "perpendicular" is meant the position of the ball in relation to the putting surface on which the ball is positioned, so that when the golfer assumes a putting stance, the dominant eye is perpendicularly positioned over the ball, the putter and the intended line. Because the back side of the ball is where impact on the ball by the putter head should take place, it is the intended line of the putt as it intersects the back side of the ball that should be perpendicular with the dominant eye of the golfer.

The reasoning behind the assumption is twofold. First, when the dominant eye is bi-directionally perpendicular to the back of the ball as it rests on the intended line, the parallax of improper positioning, i.e. inside, outside, in front of, behind or any possible combination, over the ball is reduced or eliminated. Secondly, the ability to swing the putter in a pendulum fashion back and through along the intended line is optimized and, therefore, maximizes energy transfer more consistently from the putter to the back of the ball resulting in more consistent distance and direction.

It is known that alignment of the ball is an important factor in translating the intended direction of the ball into the actual direction of the ball. Of course, the rules of actual play do not permit the use of alignment devices beyond what can be legally applied to the putter head itself, such as positioning lines, a representation of balls directly behind the putter face, and so forth. Thus, proper training should include a means by which a player can learn by repetition the proper place of the dominant eye and weight distribution in relation to the ball, the putter head and the intended line on any particular slope. Practice, trial-and-error correction, and further repetition of the corrected position have been shown to enable the player to improve proper positioning of the putter on the intended line behind the ball in a perpendicular position beneath the dominant eye. Use of the term "perpendicular" does not imply only an exact 90 degree orientation with reference to the putting surface, and may include a position perceived by the player as being perpendicular even though deviating from perpendicular. Therefore, the invention allows for a golfer to identify and practice the preferred setup more consistently, even though it may vary slightly from the more technically correct positioning.

This ability to properly position the putter on the intended line behind the ball is then taken to the golf course during actual play, permitting the player to apply training and skill in considering the environmental factors determining the proper force and direction of the putt, and then properly applying the perceptual factor to actually strike the ball in the desired direction.

SUMMARY OF THE INVENTION

Therefore, it is an object of the invention to provide an alignment device for aligning an impact point of a golf ball in order to correlate the perceived alignment of the putter on the intended line behind the ball by a golfer with the actual direction of impact.

It is another object of the invention to provide an alignment device that permits practice in properly aligning the putter on the intended line behind the golf ball in a manner that can be learned and replicated during actual play.

It is another object of the invention to provide an alignment device that permits practice in the proper setup, stance, weight distribution and balance in a manner that can be learned and replicated during actual play.

It is another object of the invention to provide an alignment device that permits practice in properly stroking the golf ball, after properly aligning and setting up, in a manner that can be learned and replicated during actual play.

It is another object of the invention to provide an alignment device that is simple, inexpensive and portable.

These and other objects of the invention will be described below in connection with an alignment device for aligning a putter on the intended line behind the impact point of a golf ball perpendicular to a dominant eye, that includes a base for being positioned on a practice putting surface and having a length sufficient to assume the surface orientation of the putting surface under the base, and an upright member positioned on the base for extending perpendicularly upwardly from the base. A first alignment member extends perpendicularly outwardly from the upright member, and includes an alignment cross member extending forwardly in a putting direction and an alignment member that extends perpendicularly outwardly from the upright member in vertical and radial alignment with the first alignment member and includes a second alignment cross member extending in a direction opposite the putting direction. The position of the first alignment member and respective first alignment cross member, and the second alignment member and respective second alignment cross member is positioned in relation to a dominant eye positioned above the upright member, and allows adjustment of the eye position to place the dominant eye in an aligned position defined by the first and second alignment members being vertically aligned relative to each other and the first and second cross-members being aligned with each other.

According to one preferred embodiment of the invention, the first and second alignment members and first and second cross members collectively form a cross-hair array, the intersection point of which defines a tangent to the impact point on a golf ball positioned on a putting surface beneath the upright member.

According to another preferred embodiment of the invention, the upright member includes a bar having a plurality of vertically-aligned, spaced-apart connection points for receiving the first and second alignment members.

According to another preferred embodiment of the invention, the upright member has a bar having a plurality of vertically-aligned, spaced-apart holes for receiving respective first and second alignment members formed of wire having a diameter sized to permit a press-fit into the spaced-apart holes.

According to another preferred embodiment of the invention, an alignment device is provided for aligning an impact point of a golf ball perpendicular to a dominant eye, and includes a base for being positioned on a practice putting surface and having a length sufficient to assume the surface orientation of the putting surface under the base, and an upright member positioned on the base for extending perpendicularly upwardly from the base. An upper alignment member extends perpendicularly outwardly from the upright member, and includes an upper alignment cross member extending forwardly of the upper alignment member, and a lower alignment member extending perpendicularly outwardly from the upright member in vertical and radial alignment with the upper alignment member, and including a lower alignment cross member extending rearwardly of the lower alignment member. The position of the upper alignment member and respective upper alignment cross member, and the lower alignment member and respective lower alignment cross member in relation to a dominant eye positioned above the upright member allows adjustment of the eye position to place the dominant eye in an aligned position defined by the upper and lower alignment members being vertically aligned relative to each other and the upper and lower cross-members being aligned with each other.

According to another preferred embodiment of the invention, vertical alignment of the upper and lower alignment members indicates that the dominant eye is positioned in vertical alignment over the upper and lower alignment members.

According to another preferred embodiment of the invention, vertical misalignment of the upper alignment member forward of the lower alignment member indicates that the dominant eye is positioned forwardly of the vertical alignment position over the upper and lower alignment members.

According to another preferred embodiment of the invention, vertical misalignment of the upper alignment member rearward of the lower alignment member indicates that the dominant eye is positioned rearward of the vertical alignment position over the upper and lower alignment members.

According to another preferred embodiment of the invention, vertical alignment of the upper and lower cross alignment members indicates that the dominant eye is positioned in vertical alignment over the upper and lower alignment cross members.

According to another preferred embodiment of the invention, vertical misalignment of the upper alignment cross member outwardly in relation to the lower alignment cross member indicates that the dominant eye is positioned inwardly of the vertical alignment position over the upper and lower alignment cross members.

According to another preferred embodiment of the invention, vertical misalignment of the upper alignment cross member inwardly in relation to the lower alignment cross member indicates that the dominant eye is positioned outwardly of the vertical alignment position over the upper and lower alignment cross members.

According to another preferred embodiment of the invention, an alignment device is provided for aligning the impact point of a golf ball perpendicular to a dominant eye, comprising a base for being positioned on a practice putting surface, and an upright member positioned on the base for extending perpendicularly upwardly from the base and for defining a position for an impact point of a golf ball. A first alignment member extends perpendicularly outwardly from the upright member, and a second alignment member extends perpendicularly outwardly from the upright member in vertical and radial alignment with the first alignment member. The position of the first alignment member and the second alignment member in relation to a dominant eye positioned above the upright member allows adjustment of the eye position sufficient to place the dominant eye in an aligned position defined by the first and second alignment members being vertically aligned relative to each other.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENTS AND BEST MODE

Figure 1:
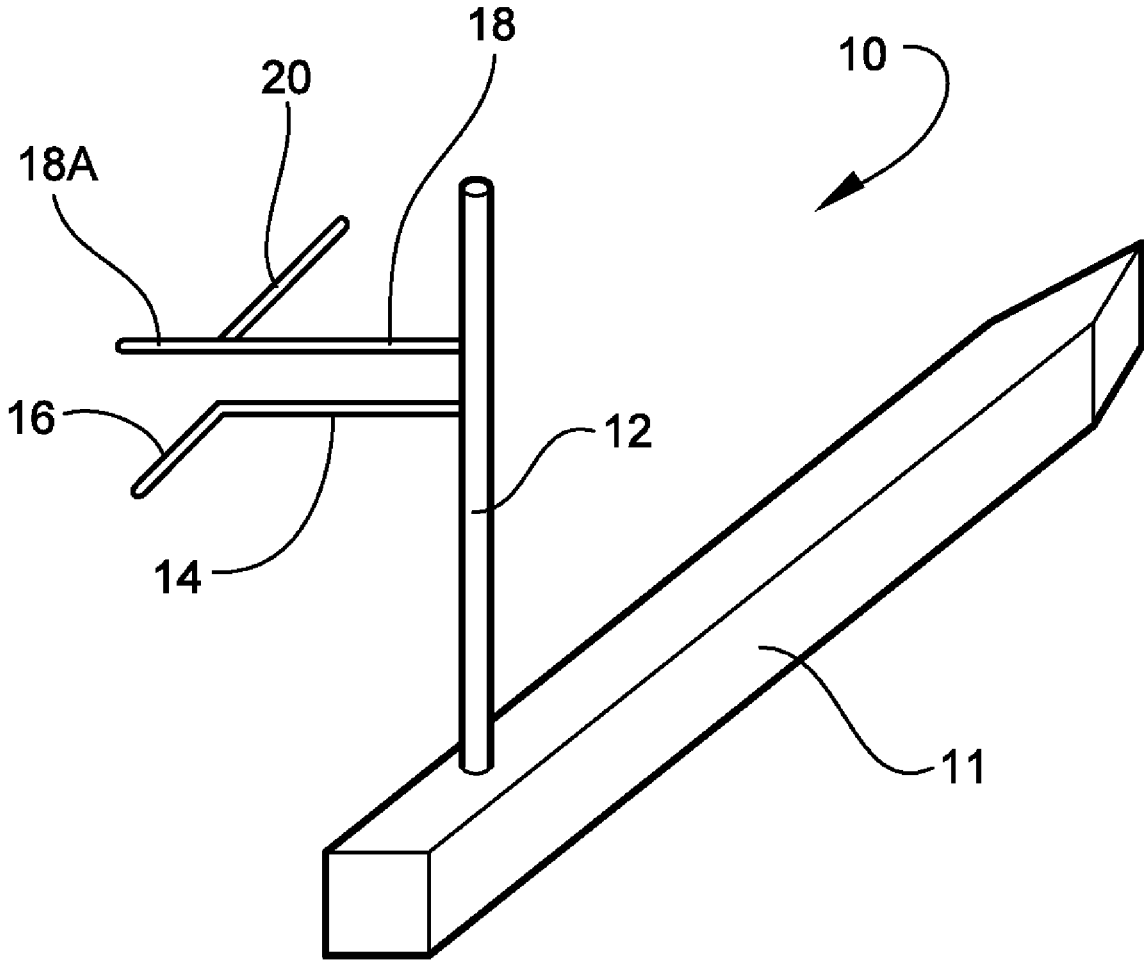
FIG. 1 is a perspective view of an alignment device according to one embodiment of the invention.

Referring now specifically to the drawings, a golf ball alignment device according to the present invention is shown generally in FIG. 1 at reference numeral 10. The alignment device 10 includes a base 11 for being positioned on a practice putting surface. The base 11 has a length sufficient to provide stability to the device 10, and to assume the surface orientation of the putting surface under the base 11, and a pointed front end to indicate the proper orientation. A suitable base 11 can be constructed of a 1 inch by 1 inch post approximately 12-24 inches long, which may be wood, plastic, metal or another suitable material. The device 10 also includes an upright member 12, such as a ¼ inch dowel, positioned on the base 11 and extending perpendicularly upwardly from the base 11. The base 11 assumes the surface orientation in both front-to-back and side-to-side directions, so that, for example, the proper alignment is automatically achieved when the base is on a sidehill area of the practice surface, and will naturally place the golfer either closer to or further from the base, if the sidehill direction is towards or away from the golfer, respectively.

A first alignment member 14, preferably a wire or thin metal rod, extends perpendicularly outwardly from the upright member 12, and includes a first alignment cross member 16 extending rearwardly in a direction opposite the putting direction, i.e., opposite the general direction in which the ball will be struck by the player. A second alignment member 18 is positioned approximately one inch above the first alignment member 14 and extends perpendicularly outwardly from the upright member 12 in vertical and radial alignment with the first alignment member 14, and includes a second alignment cross member 20 extending in the putting direction, i.e., in a direction in which the ball will be struck by the player. Either alignment member 14 or 18 can be positioned above the other alignment member 14 or 18. The second alignment member 18 includes an extension 18A that extends outwardly beyond the cross-member 20 to provide the visual effect of "cross-hairs" during use.

Optionally, the second alignment cross-member 20 may be made substantially longer that the first alignment cross-member so as to extend forwardly a sufficient distance to provide an enhanced indication of the direction of ball and putter head movement.

Figure 2:
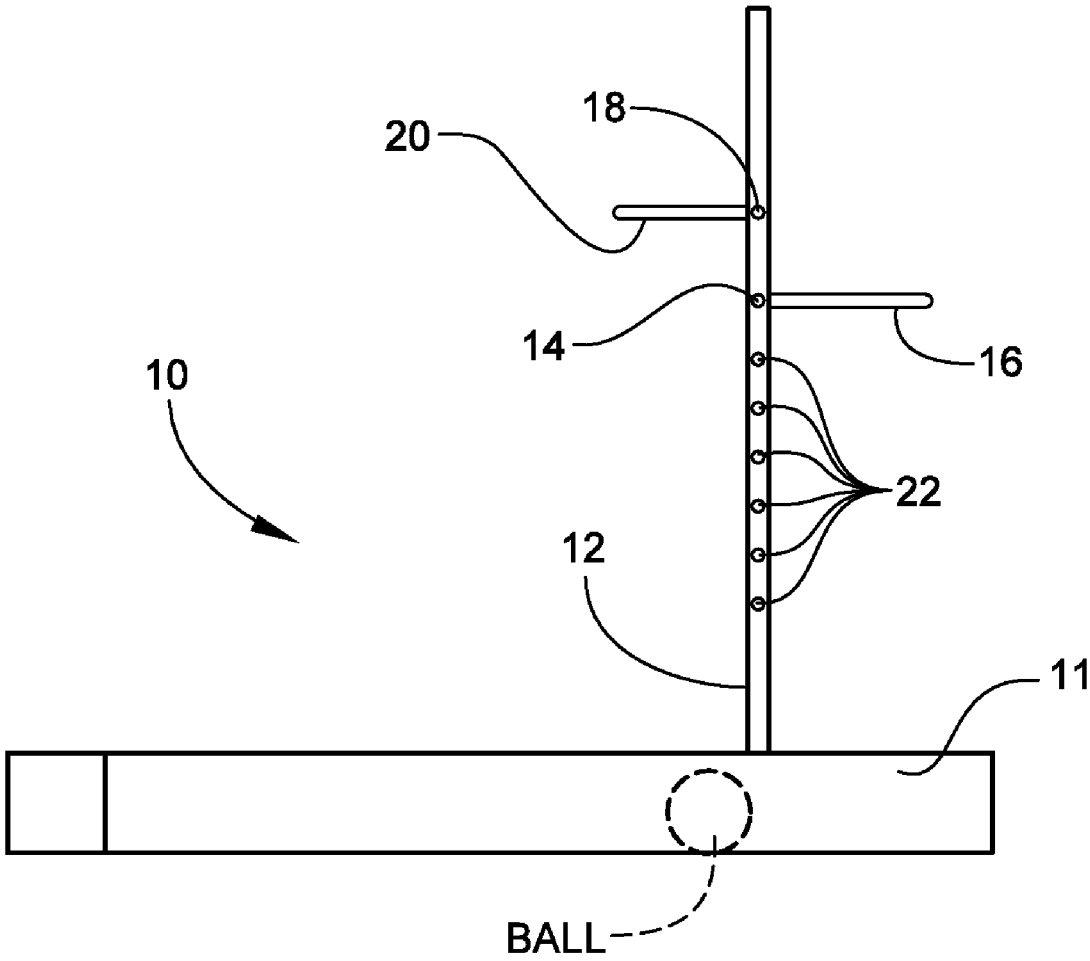
FIG. 2 is a side elevation of the alignment device shown in FIG. 1.

As is best shown in FIG. 2, the upright member 12 includes connection points, such as several holes 22 into which the first and second alignment members 14 and 18 are inserted. According to one preferred embodiment of the invention, the holes 22 are spaced-apart starting about 6 inches above ground level and extend upwardly along the upright member 12 in a row to about the 16 inch level above the ground. Having multiple placement options for the first and second alignment members 14 and 18 allows golfers to make a use selection based upon their own preferences without changing the purpose of the device.

By reference to FIGS. 2 and 3, it will be seen that the ball is intended to be positioned with the back of the ball directly below the vertically-aligned first and second alignment members 14, 18, with the ball visually bisected by the forwardly-extending first alignment cross member 16.

The position of the first alignment member 14 and the respective first alignment cross member 16, and the second alignment member 18 and respective second alignment cross member 20 in relation to the dominant eye of the golfer allows adjustment of the eye position sufficient to place the dominant eye in a properly-aligned position. This position is defined by the first and second alignment members 14 and 18 being vertically aligned relative to each other and the first and second cross-members 16 and 20 being aligned with each other in the manner shown in FIG. 3A. The golfer at address in this position is shown in FIG. 3B, with his dominant eye directly, perpendicularly over the rear of the ball.

Figure 4A:
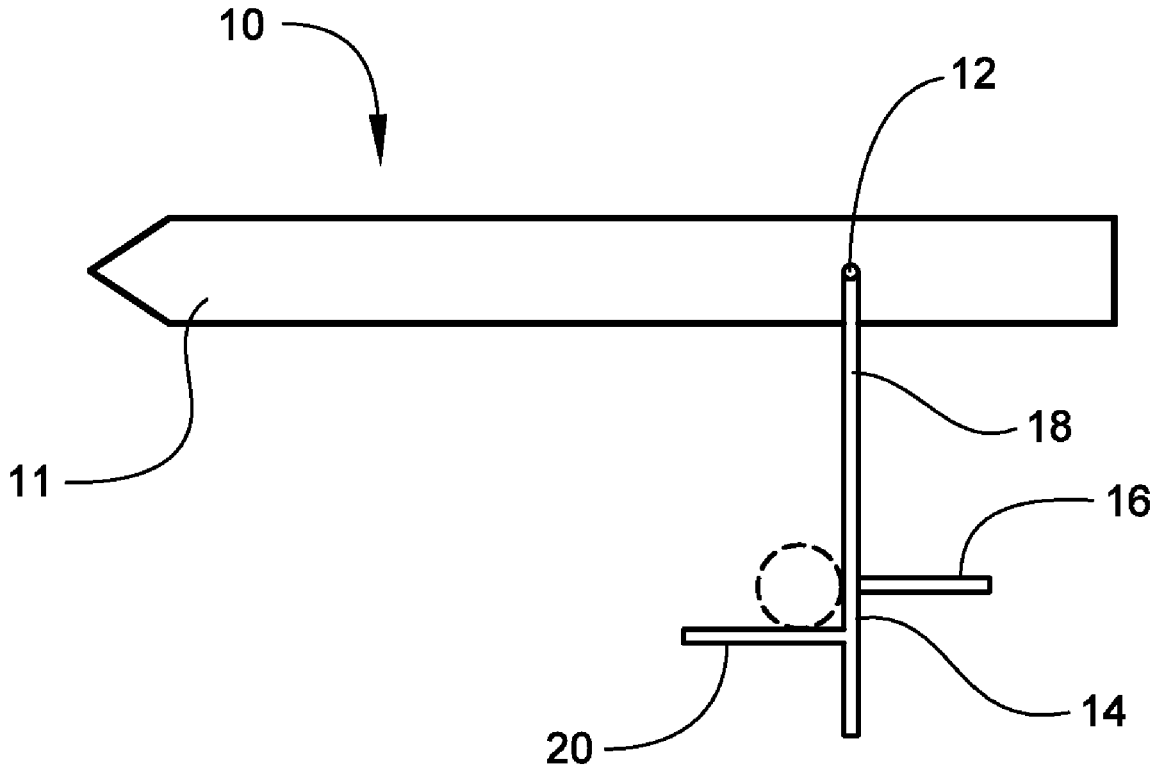
FIG. 4A is a top plan view of the alignment device shown in FIG. 1, illustrating a misalignment indicating that the dominant eye is positioned outwardly of the vertical alignment position over the upper and lower alignment cross members.
Figure 4B:
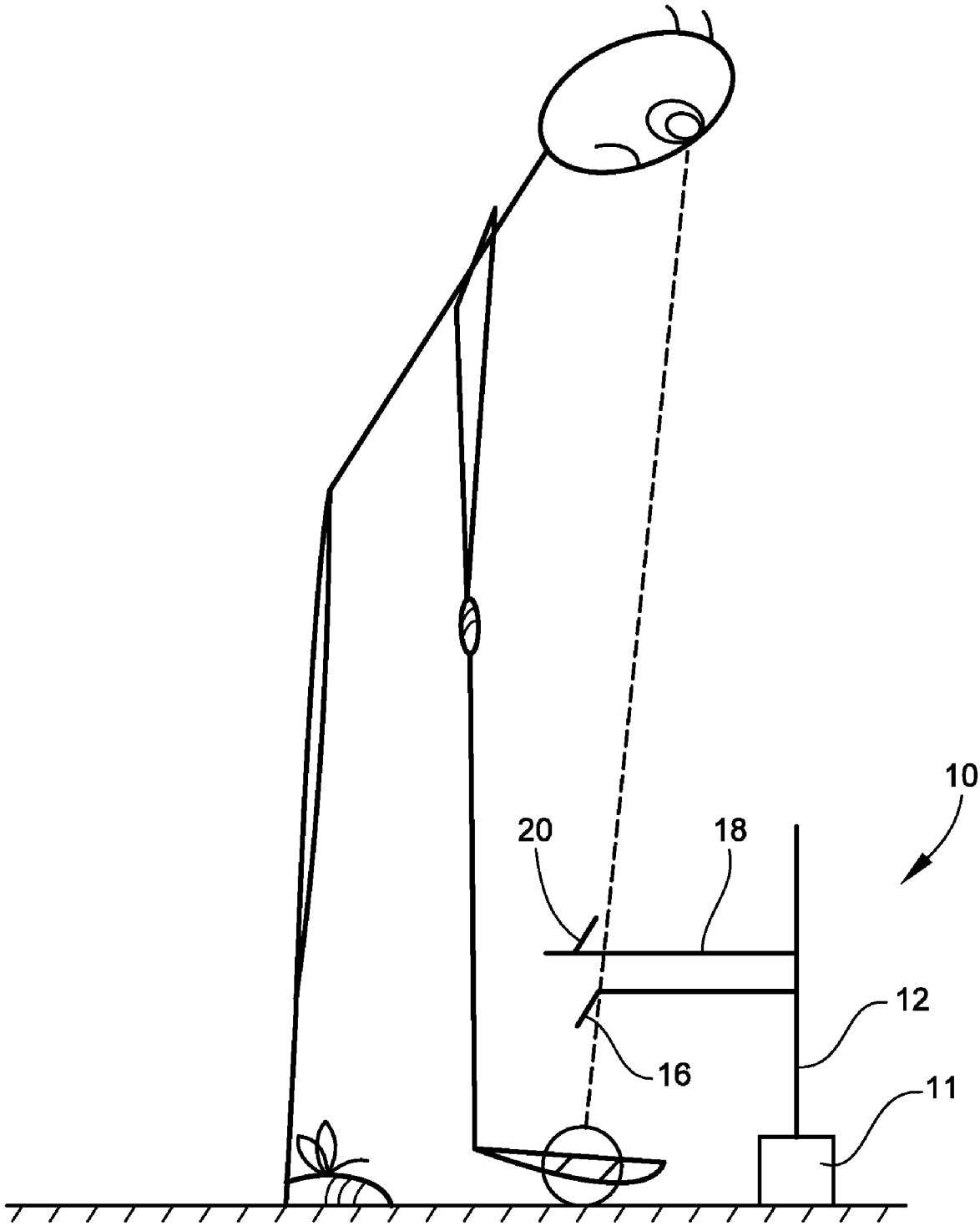
FIG. 4B shows the orientation of the player in relation to the position shown in FIG. 4A.

Referring now to FIG. 4A a misalignment is illustrated, indicating that the dominant eye is positioned outwardly of the proper vertical alignment position over the upper and lower alignment cross members 20 and 16, making it appear to the golfer that the lower alignment cross member 16 extends further out from the upright member 12 than does the upper alignment cross member 20. FIG. 4B shows the orientation of the player in relation to the misalignment position shown in FIG. 4A.

Figure 5A:
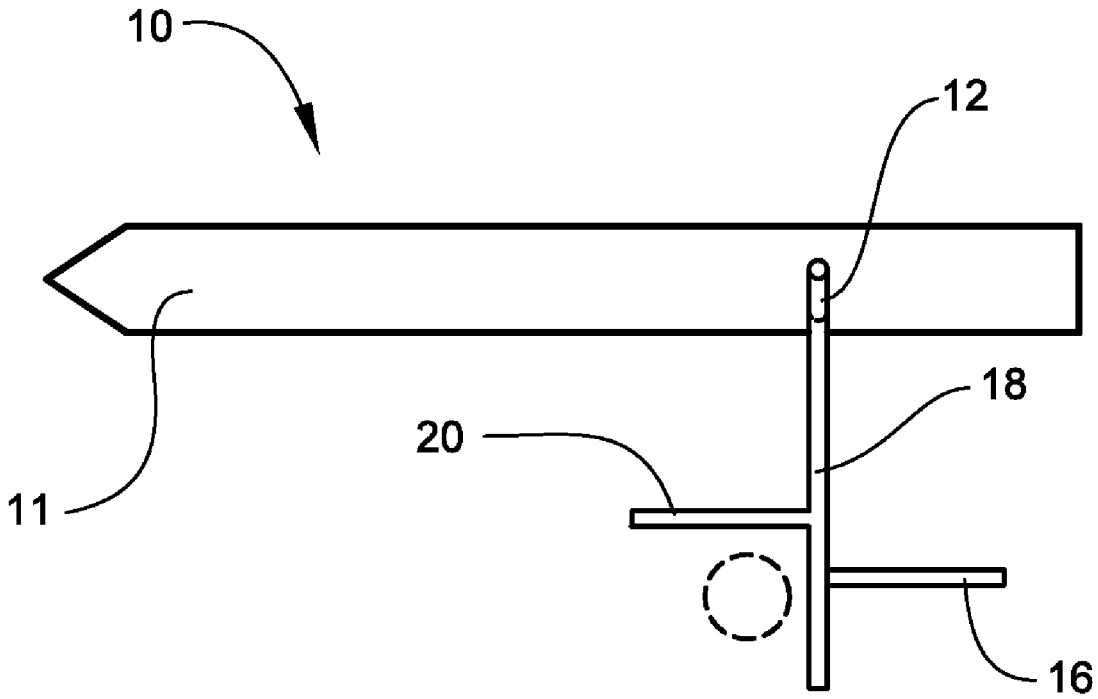
FIG. 5A illustrates a misalignment indicating that the dominant eye is positioned inwardly of the vertical alignment position over the upper and lower alignment cross members.
Figure 5B:
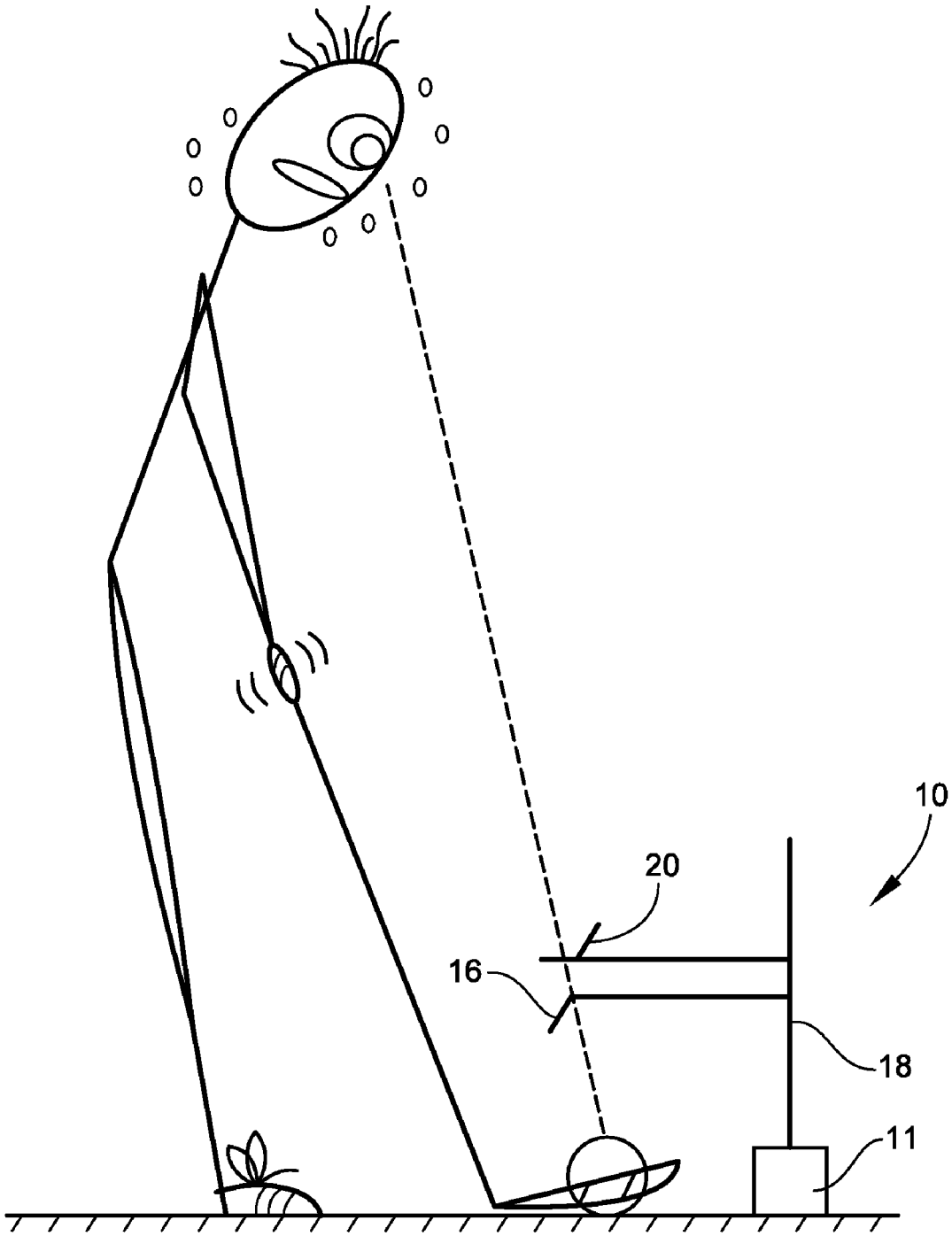
FIG. 5B shows the orientation of the player in relation to the position shown in FIG. 5A.

As is shown in FIG. 5A, a misalignment indicates that the dominant eye is positioned inwardly of the proper vertical alignment position over the upper and lower alignment cross members 20 and 16, making it appear to the golfer that the upper alignment cross member 20 extends further out from the upright member 12 than the lower alignment cross member 16. FIG. 5B shows the orientation of the player in relation to the position shown in FIG. 5A.

As noted above, a player may determine through use of the device 10 that a position deviating slightly from the true perpendicular provides the best results. If this is the case, the first and second alignment members 14 and 18 can be adjusted as required to provide a proper alignment indication at the player's desired position.

Figure 6:
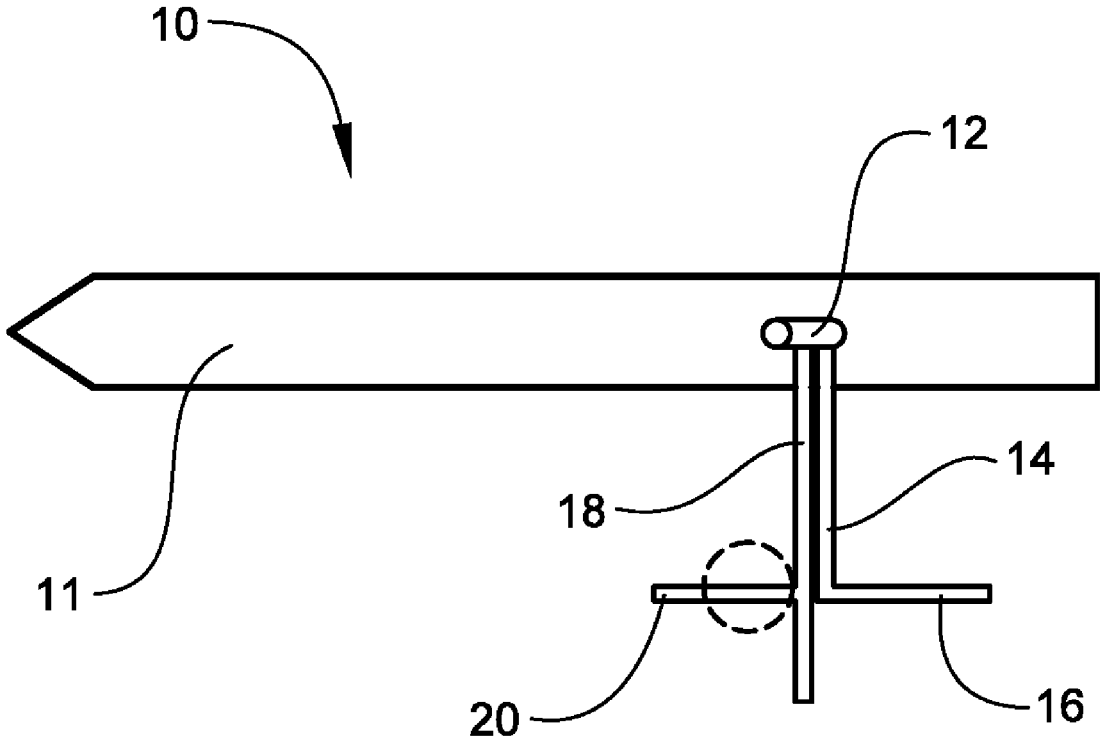
FIG. 6 is a top plan view illustrating a misalignment indicating that the dominant eye is positioned rearwardly of the vertical alignment position over the upper and lower alignment cross members.
Figure 7:
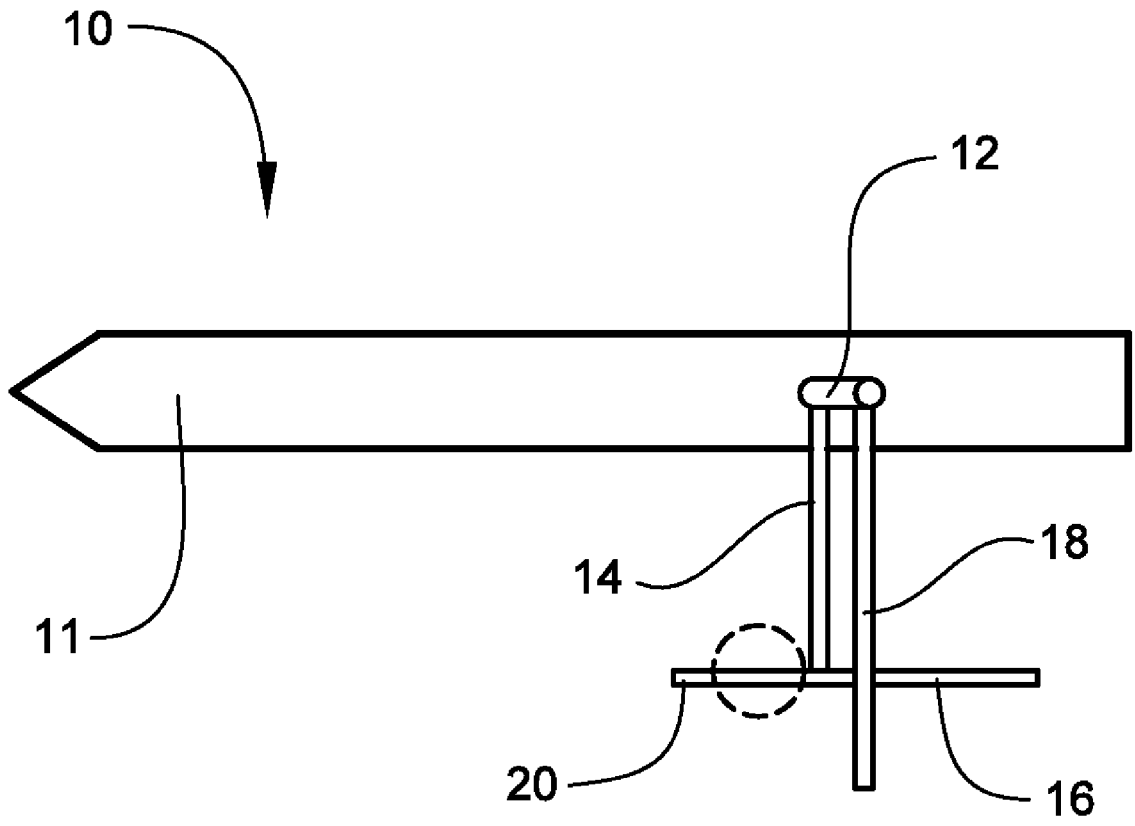
FIG. 7 is a top plan view illustrating a misalignment indicating that the dominant eye is positioned forwardly of the vertical alignment position over the upper and lower alignment cross members.

FIG. 6 illustrates a misalignment indicating that the dominant eye is positioned rearwardly of the vertical alignment position over the upper and lower alignment cross members, and FIG. 7 illustrates a misalignment indicating that the dominant eye is positioned forwardly of the vertical alignment position over the upper and lower alignment cross members.

Figure 8:
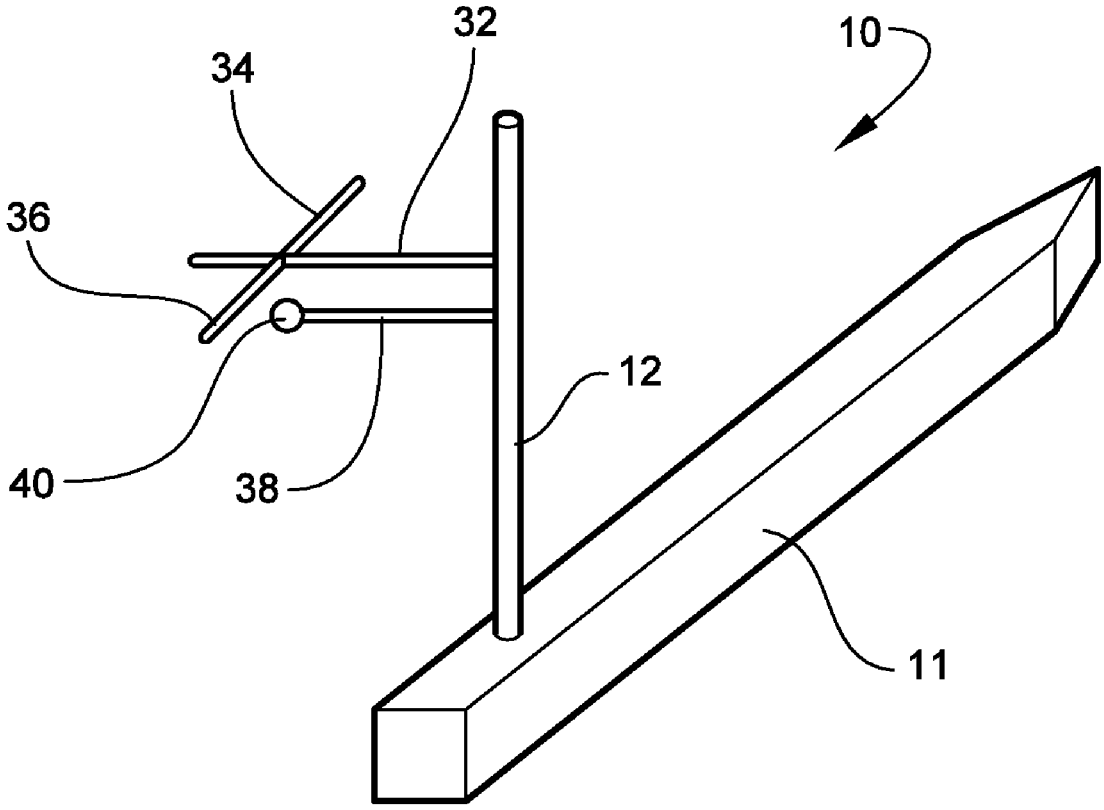
FIG. 8 is a perspective view of an alternative embodiment of the invention.

FIG. 8 illustrates an alternative embodiment of the alignment device 30, with like reference numerals indicating like elements to those of the alignment device 10, where a first alignment member 32 has front and rear-extending cross alignment members 34, 36, with a second, lower alignment member 38. The second, lower alignment member 38 may optionally include a small head 40 on the end, preferably having a diameter no greater than the diameter of the first alignment member 32. Aligning the head 40 underneath the first alignment member 32 so that it cannot be seen with the dominant eye indicates that the dominant eye is properly aligned.

Figure 3A:
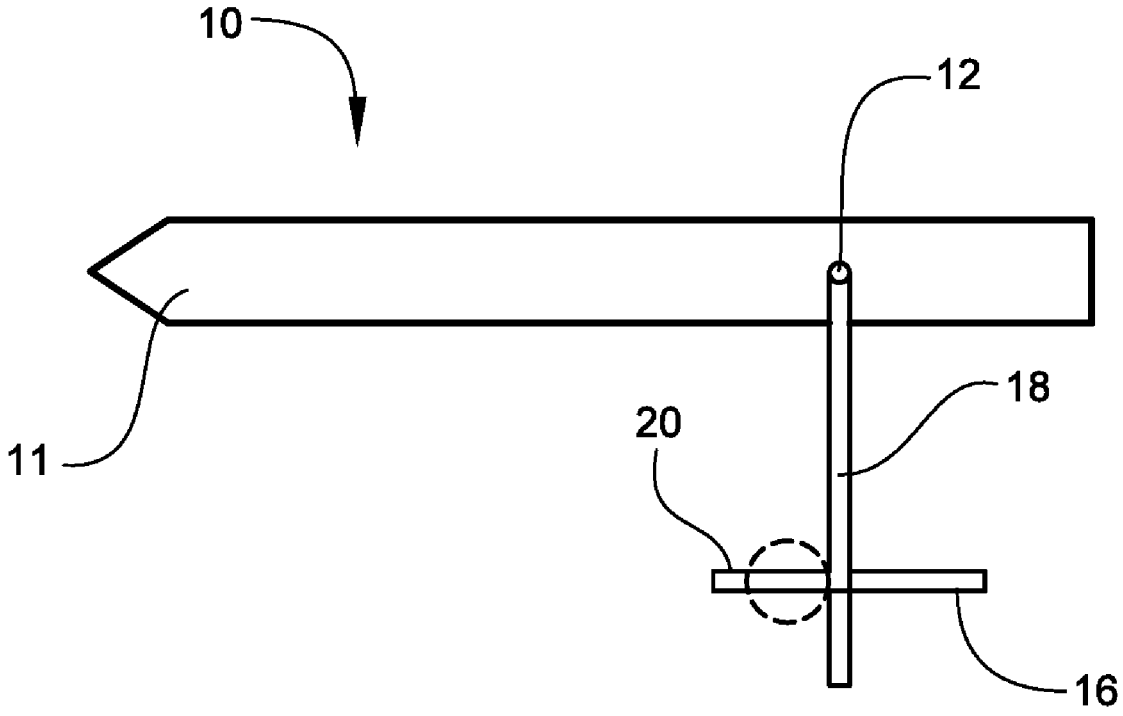
FIG. 3A is a top plan view of the alignment device shown in FIG. 1, illustrating proper alignment in relation to the dominant eye.
Figure 3B:
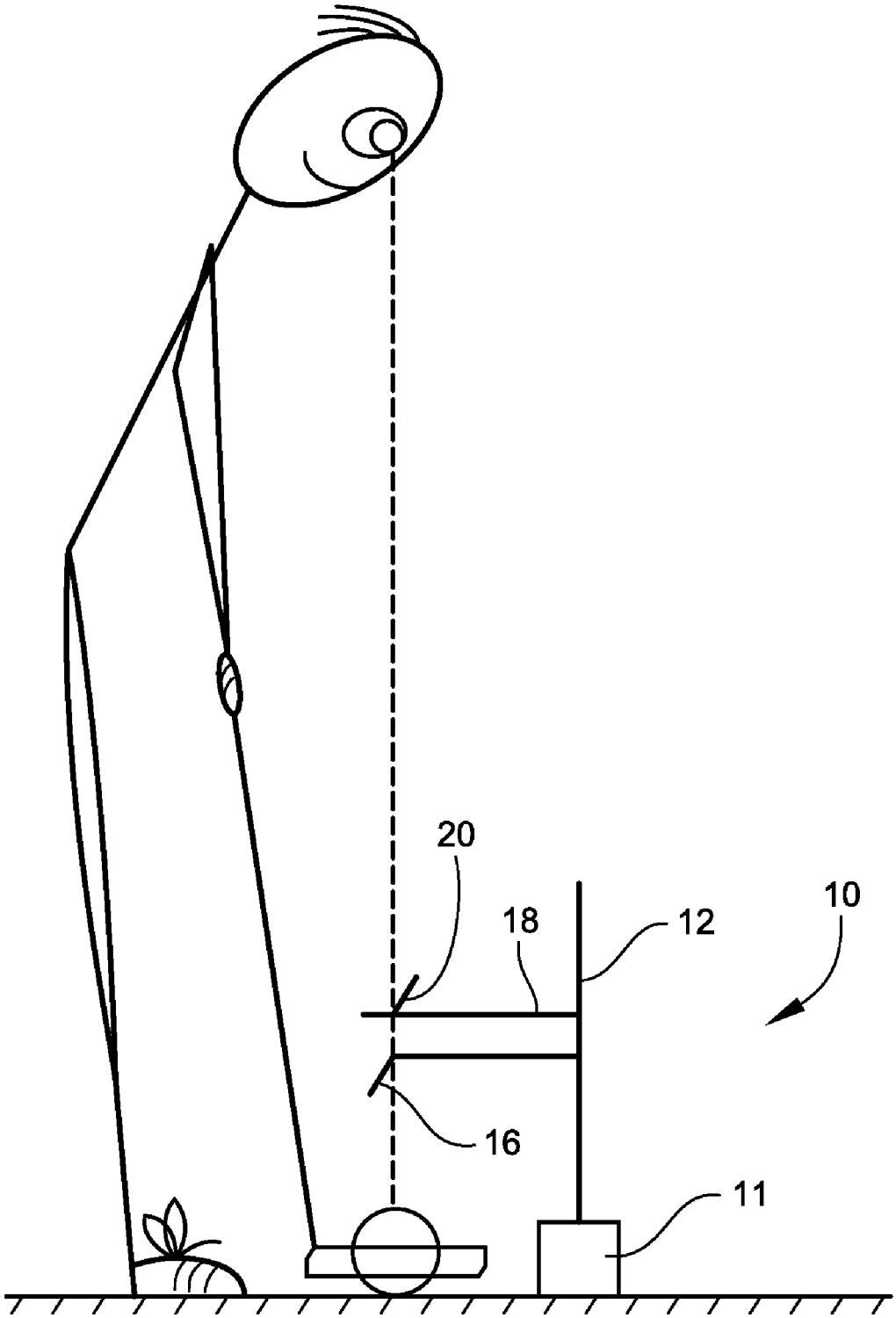
FIG. 3B shows the orientation of the player in relation to the position shown in FIG. 3A.

As the golfer practices putting with the alignment devices 10 or 30, and encounters the misalignments described in this application, correction can be made by reorienting the dominant eye so as to result in the view shown in FIGS. 3A and 3B. Use of the devices 10 and 30 permit a golfer to practice putting in a manner that permits association of putts missed to the left or right of the hole with various misalignments as described above and illustrated in the drawings. The base 11 permits the alignment devices 10 and 30 to be aligned parallel with the ground on which the base 11 rests. Over time, visual feedback and correction permit the golfer to putt during regular play without the alignment device by retaining the mental impression of the proper alignment, thereby increasing the probability of striking the ball in such a manner that the ball travels in the direction actually perceived by the golfer.

An improved golf ball alignment device is described above. Various details of the invention may be changed without departing from the scope of the invention. Furthermore, the foregoing description of the preferred embodiment of the invention and best mode for practicing the invention are provided for the purpose of illustration only and not for the purpose of limitation, the invention being defined by the claims.

I claim:

1. An alignment device for aligning an impact point of a golf ball perpendicular to a dominant eye, comprising:

(a) a base for being positioned on a practice putting surface and having a length sufficient to assume the surface orientation of the putting surface under the base;

(b) an upright member positioned on the base for extending perpendicularly upwardly from the base;

(c) a first alignment member extending perpendicularly outwardly from the upright member, and including a first elongate alignment cross member carried by the first alignment member, and having a free end pointed forwardly in a putting direction; and (d) a second alignment member extending perpendicularly outwardly from the upright member in vertical and radial alignment with the first alignment member and including a second elongate alignment cross member carried by the second alignment member, and having a free end pointed in a direction opposite the putting direction, the first and second elongate cross members being vertically positioned on the upright member to align laterally and longitudinally with each other in relation to a desired position of the ball.

2. An alignment device according to claim 1, wherein the first and second alignment members and first and second cross members collectively form a cross-hair array, the intersection point of which defines a tangent to the impact point on a golf ball positioned on a putting surface beneath the upright member.

3. An alignment device according to claim 1, wherein the upright member comprises a bar having a plurality of vertically-aligned, spaced-apart connection points for receiving the first and second alignment members.

4. An alignment device according to claim 1, wherein the upright member comprises a bar having a plurality of vertically-aligned, spaced-apart holes for receiving respective first and second alignment members formed of wire having a diameter sized to permit a press-fit into the spaced-apart holes.

5. An alignment device for aligning an impact point of a golf ball perpendicular to a dominant eye, comprising:

(a) a base for being positioned on a practice putting surface and having a length sufficient to assume the surface orientation of the putting surface under the base;

(b) an upright member positioned on the base for extending perpendicularly upwardly from the base;

(c) an upper alignment member extending perpendicularly outwardly from the upright member, and including an upper alignment cross member having a free end extending forwardly of the upper alignment member;

(d) a lower alignment member extending perpendicularly outwardly from the upright member in vertical and radial alignment with the upper alignment member and including a lower alignment cross member having a free end extending rearwardly of the lower alignment member, the first and second elongate cross members being vertically positioned on the upright member to align laterally and longitudinally with each other in relation to a desired position of the ball;

(e) whereby the position of the upper alignment member and respective upper alignment cross member, and the lower alignment member and respective lower alignment cross member in relation to a dominant eye positioned above the upright member allows adjustment of the eye position to place the dominant eye in an aligned position defined by the upper and lower alignment members being vertically aligned relative to each other and the upper and lower cross-members being aligned with each other.

6. An alignment device according to claim 5, wherein vertical alignment of the upper and lower alignment members indicates that the dominant eye is positioned in vertical alignment over the upper and lower alignment members.

7. An alignment device according to claim 5, wherein vertical misalignment of the upper alignment member forward of the lower alignment member indicates that the dominant eye is positioned forwardly of the vertical alignment position over the upper and lower alignment members.

8. An alignment device according to claim 5, wherein vertical misalignment of the upper alignment member rearward of the lower alignment member indicates that the dominant eye is positioned rearward of the vertical alignment position over the upper and lower alignment members.

9. An alignment device according to claim 5, wherein vertical alignment of the upper and lower cross alignment members indicates that the dominant eye is positioned in vertical alignment over the upper and lower alignment cross members.

10. An alignment device according to claim 5, wherein vertical misalignment of the upper alignment cross member outwardly in relation to the lower alignment cross member indicates that the dominant eye is positioned inwardly of the vertical alignment position over the upper and lower alignment cross members.

11. An alignment device according to claim 5, wherein vertical misalignment of the upper alignment cross member inwardly in relation to the lower alignment cross member indicates that the dominant eye is positioned outwardly of the vertical alignment position over the upper and lower alignment cross members.

* * * * *